United States Patent [19]

Bahneman

[11] 4,007,853

[45] Feb. 15, 1977

[54] ANTI-THEFT DISPENSING RACK

[75] Inventor: Vern A. Bahneman, Detroit, Mich.

[73] Assignee: Marvin Hofmann, Birmingham, Mich. ; a part interest

[22] Filed: Aug. 1, 1975

[21] Appl. No.: 601,236

[52] U.S. Cl. ..... 221/3; 312/42; 312/117

[51] Int. Cl.[2] ..... A47F 3/024

[58] Field of Search ..... 221/2, 3, 6–8, 221/92, 14, 309; 312/42, 117, DIG. 21

[56] References Cited

UNITED STATES PATENTS

| | | | |
|---|---|---|---|
| 3,313,448 | 4/1967 | Suttle et al. | 221/7 X |
| 3,450,308 | 6/1969 | Schoenefeld | 221/309 X |
| 3,746,211 | 7/1973 | Burgess | 221/7 |
| 3,753,507 | 8/1973 | James et al. | 221/7 X |
| 3,884,386 | 5/1975 | Urcola | 221/7 |

*Primary Examiner*—Robert B. Reeves
*Assistant Examiner*—Francis J. Bartuska
*Attorney, Agent, or Firm*—McGlynn and Milton

[57] ABSTRACT

A dispensing rack assembly which includes an enclosure for storing one or more items to be dispensed, an access opening communicating with the interior of the enclosure through which an item can be withdrawn, and a detection device associated with the opening for detecting the withdrawal of an item from the enclosure wherein the detection device includes a radiant energy emitting device, such as an incandescent light, for directing a beam of radiant energy near the access opening, a receiving device, such as a photoelectric cell, associated with the emitting device for receiving the beam of radiant energy, and an electric circuit associated with the receiving device including a control responsive to a change in the beam received by the receiving device and a signal device actuatable by the control whereby withdrawal of an item from the enclosure changes the beam and actuates the signal device. The invention is also directed to support members for supporting the detection device so that it can be attached and removed from a dispensing rack and so that the positions of the emitting and receiving devices can be adjusted. Specific features of the dispensing rack are also disclosed.

13 Claims, 8 Drawing Figures

ANTI-THEFT DISPENSING RACK

This invention relates to an anti-theft or security device employing radiant energy emitting and receiving means for controlling an alarm or other signal device. The invention is particularly useful in combination with a dispensing rack for detecting the removal of items from the rack.

The prevention of shoplifting has always been of primary concern to shopkeepers and others involved in the retail business. Many security systems have been designed in an attempt to reduce losses caused by shoplifting. In particular, dispensing racks for dispensing relatively valuable items have been designed which include mechanically actuated signal means for ringing a bell or other signal device when an item is removed from the dispensing rack. Dispensing racks of this general description are shown in U.S. Pat. Nos. 1,592,720, issued July 13, 1926; 2,304,533, issued Dec. 8, 1942; and 2,626,388, issued Jan. 20, 1953. The instant invention provides a security device for use in combination with a dispensing rack which includes radiant energy emitting and receiving means for detecting the removal of an item from the dispensing rack and for controlling a signal device or other alarm circuit for activating one or more signals.

By way of example, a common grocery store item which is particularly attractive to shoplifters is a carton of cigarettes since it is relatively valuable in comparison to other items in the store and can be easily disposed of. In order for a professional shoplifter to make money stealing cartons of cigarettes, a large number of cartons, such as, five to ten cartons, must be taken at a time. In most large supermarkets, cartons of cigarettes are displayed in an open dispensing rack. The shoplifter can easily and quickly remove a number of cartons and secret them away in loose clothing to avoid detection. The key to the shoplifters success during these activities is to remain as inconspicuous as possible. The instant invention is designed to make it more difficult for a shoplifter to rapidly remove multiple cartons of cigarettes from a dispensing rack and to detect removal of each carton of cigarettes to activate various signals or other security devices in order to alert store personnel and/or draw attention to the shoplifter. It must be remembered, however, that since cigarette dispensing racks are designed for self-service, the security system associated with it must not discourage bona fide shoppers from removing cartons of cigarettes for purchase.

Although the foregoing discussion has been directed to a dispensing rack for cigarettes, it should be recognized that the instant invention is applicable to dispensing racks for other types of items.

Briefly described, one form of the invention comprises a dispensing rack including an enclosure for storing one or more items to be dispensed. The dispensing rack further includes an access opening communicating with the interior of the enclosure through which an item can be withdrawn. Detection means is associated with the access opening for detecting the withdrawal of an item from the enclosure. The detection means includes a device for emitting a beam of radiant energy near the access opening and a receiving device for receiving the beam of radiant energy. In the preferred embodiment of the invention, the emitting device is an incandescent light and receiving device is a photoelectric cell. Circuit means is associated with the receiving device which includes control means responsive to a change in the beam and signal means capable of being actuated by the control means whereby withdrawal of an item from the enclosure changes the beam and actuates the signal means.

It is also intended that the detection means be independently supported so that it can be easily attached to or removed from the dispensing rack. This permits fast and convenient conversion of a dispensing rack to add or remove the anti-theft security device. Accordingly, a pair of elongated support members are provided. Attachment means, such as, suitable brackets, is provided for removably securing the anti-theft security device to the dispensing rack. The attachment means permits fast and convenient conversion of the dispensing rack. The radiant energy emitting means is supported by one of the support members while the radiant energy receiving means is supported by the other of the support members. Adjustment means is provided for permitting adjustment of the positions of the emitting and receiving means with respect to the support members. The emitting and receiving means can, therefore, be properly aligned with respect to the access openings of a particular dispensing rack.

The dispensing rack itself also includes structural features which make it particularly suited for its intended function. Specifically, the dispensing rack includes an inclined, generally horizontal support surface sloping downwardly toward the access opening which is adapted to support a vertical stack of items in askew relationship to position an item adjacent the access opening and to expose a portion of its upper surface. A recess is provided along the lower edge of the support surface for exposing a portion of the underside of the item nearest the access opening. Thus, the combination of the askew stacking arrangement and the recess exposes portions of the upper and lower surfaces of the item nearest the access opening so that it can be manually grasped and withdrawn from the enclosure through the access opening.

Other advantages of the instant invention will be readily appreciated as the same becomes better understood by reference to the following detailed description when considered in connection with the accompanying drawings wherein.

Figure 1:
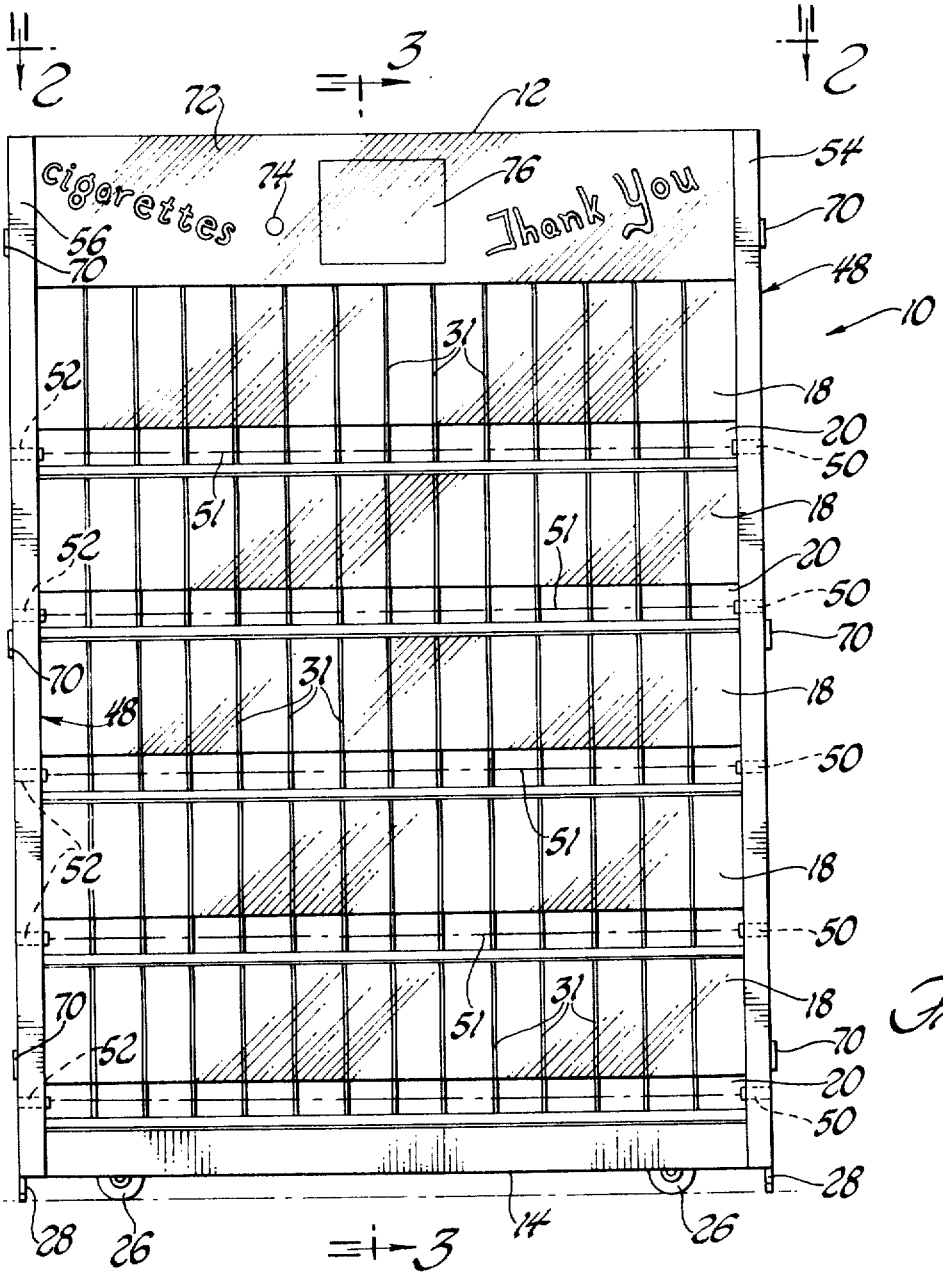
FIG. 1 is a front-elevational view of a dispensing rack including an anti-theft security device constructed in accordance with the instant invention.

Referring to the drawings, a dispensing rack assembly constructed in accordance with the instant invention is generally shown at 10. The dispensing rack 10 includes a top wall 12, a bottom wall 14, and side walls 16. As will be described in greater detail herein, the front of the dispensing rack includes a number of clear plastic panels 18 which enclose much of the front of the dispensing rack 10 except for access openings below the panels 18 such as are shown at 20. The walls and panels together form an enclosure for storing items to be dispensed. Rather than an open rack arrangement, items must be withdrawn from the interior of the enclosure through the access openings 20.

The rear of the dispensing rack 10 is provided with doors 22 to permit restocking of the dispensing rack 10. A key-operated lock, or its equivalent, is provided to prevent unauthorized access to the interior of the dispensing rack through the doors 22. The dispensing rack may also be provided with wheels or castors 26 to facilitate mobility of the dispensing rack 10. Retractable stops 28 are employed to hold the dispensing rack in place when the dispensing rack is positioned and further movement is not desired.

The interior of the dispensing rack 10 is divided into a plurality of compartments by means of generally horizontally extending shelves 30, which define support surfaces, and vertically extending dividers 31. The shelves 30 include a generally flat or level rear portion 32 which is adapted to receive additional stock. The forward portion 34 of the shelves 30 are inclined so that they slope downwardly toward the access opening 20. Since many common items are packaged in rectangularly shaped packages, such as cigarette cartons, the inclined portion 34 of the shelf 30, in conjunction with the vertically extending panel 18, forces a stack of items to assume an askew relationship. The askew relationship is shown most clearly in FIG. 7. Since the cartons 36 are most conveniently stacked in vertical relationship, the askew stacking arrangement exposes a portion 38 of the upper surface of the carton nearest the access opening 20. Additionally, a recess, generally indicated at 40, is formed adjacent the lower edge of the access opening 20 by the downwardly extending wall 42 and outwardly extending wall 44 which, conveniently, are integral extentions of the inclined surface 34 of the shelf 30. The depth of the recess 40 is such to expose a portion 46 of the underside of the carton 36 adjacent the access opening 20.

Figure 7:
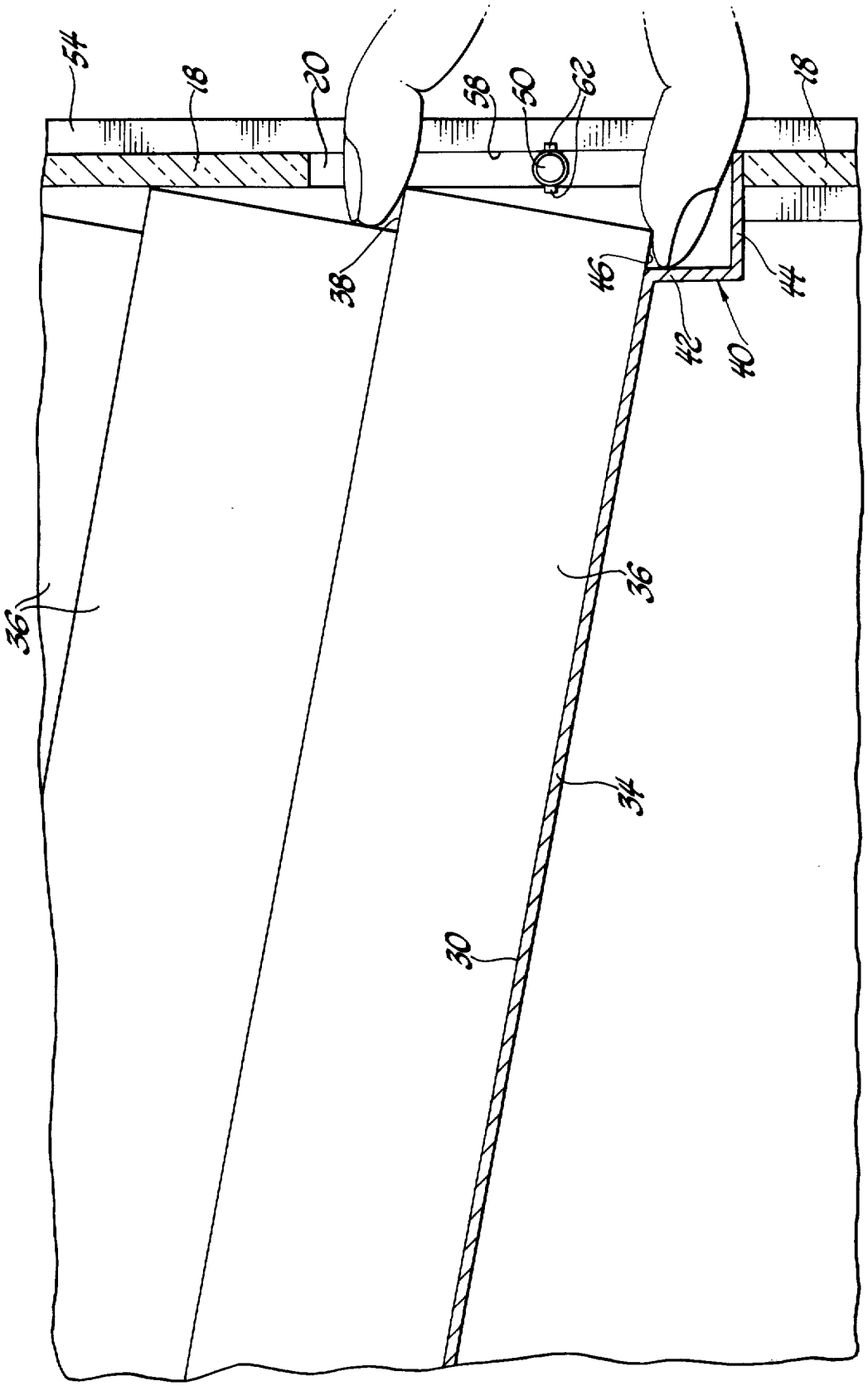
FIG. 7 is a cross-sectional view of the dispensing rack assembly illustrating its operation.

The combination of the askew stacking arrangement and the recess 40 exposes portions 38 and 46 of the upper and lower surfaces of the carton 36 adjacent the access opening 20 so that the carton may be easily manually grasped as shown in FIG. 7 for removal. Only a single carton 36, however, can be removed from a compartment at any one time. This, of course, is due to the fact that the panel member 18 covers the entire front of the compartment except for the access opening 20. In order to insure that only a single carton 36 can be removed, the panel member 18 terminates above the support surface 34 a distance greater than the vertical height of one carton 36, but less than twice the vertical height of the carton 36. In this way, the next carton 36 in the vertical stack cannot be removed with the carton nearest the access opening 20. Once the nearest carton is removed, the stack drops by gravity onto the support surface 34 thus bringing another carton into position for removal. It should be apparent that, by this arrangement, removing a large number of cartons from the dispensing rack 10 consumes more time than removing the same number of cartons from an open rack. The bona fide shopper is not greatly inconvenienced since one would normally only remove one or two cartons for an average purchase. The shoplifter, whose time is limited, must take a greater number of cartons and the added time required by the dispensing rack becomes a distinct deterrent.

The dispensing rack 10 also includes detection means generally indicated at 48 associated with the access openings 20 for detecting the withdrawal of an item, e.g., a carton of cigarettes 36, from within the enclosure defined by the dispensing rack 10. The detection means includes radiant energy emitting means 50 for directing a beam of radiant energy near the access openings 20. Radiant energy receiving means 52 is associated with the emitting means 50 for receiving the beam of radiant energy. As will be described in greater detail, the receiving means 52 is connected to a signal or other device which is activated when an item is removed from the rack 10.

Figure 6:
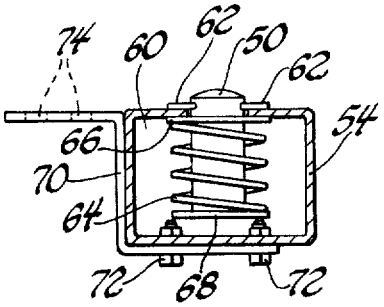
FIG. 6 is a view taken generally along line 6—6 of FIG. 5.
Figure 2:
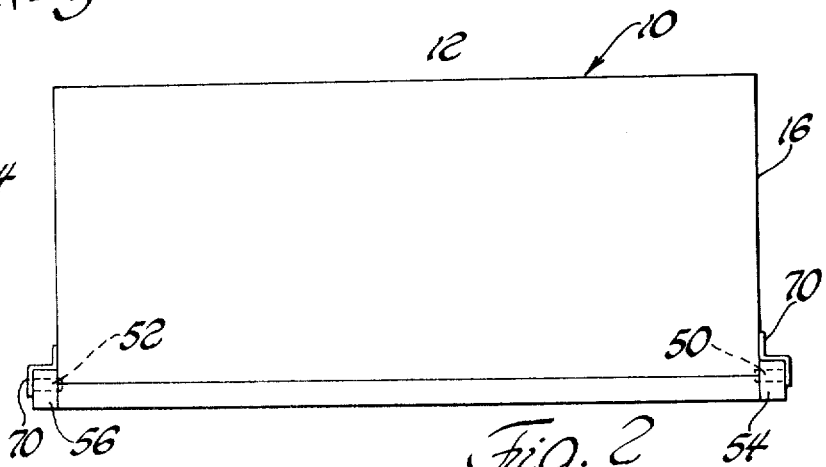
FIG. 2 is a view taken generally along line 2—2 of FIG. 1.
Figure 3:
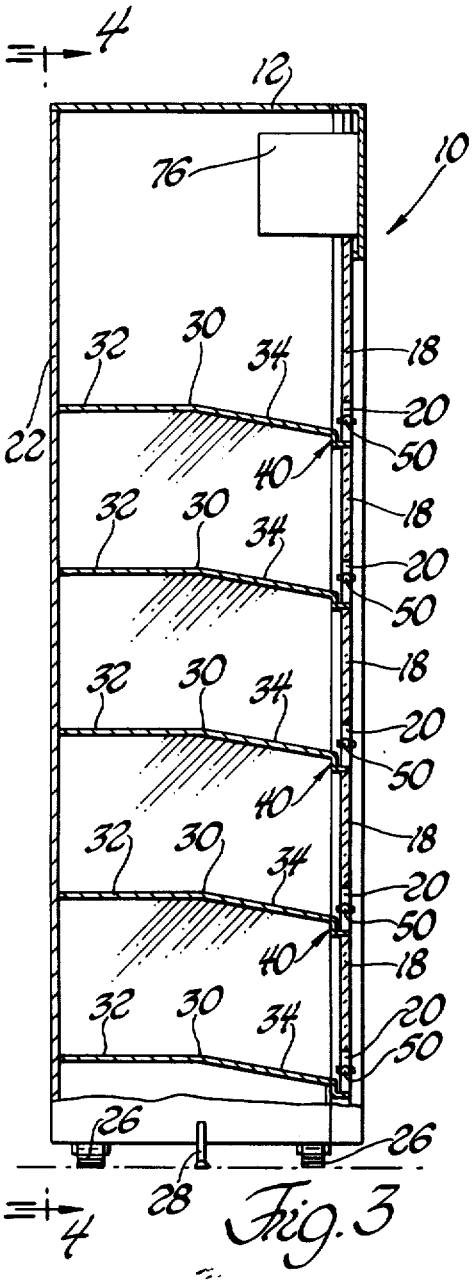
FIG. 3 is a cross-sectional view taken generally along line 3—3 of FIG. 1.
Figure 4:
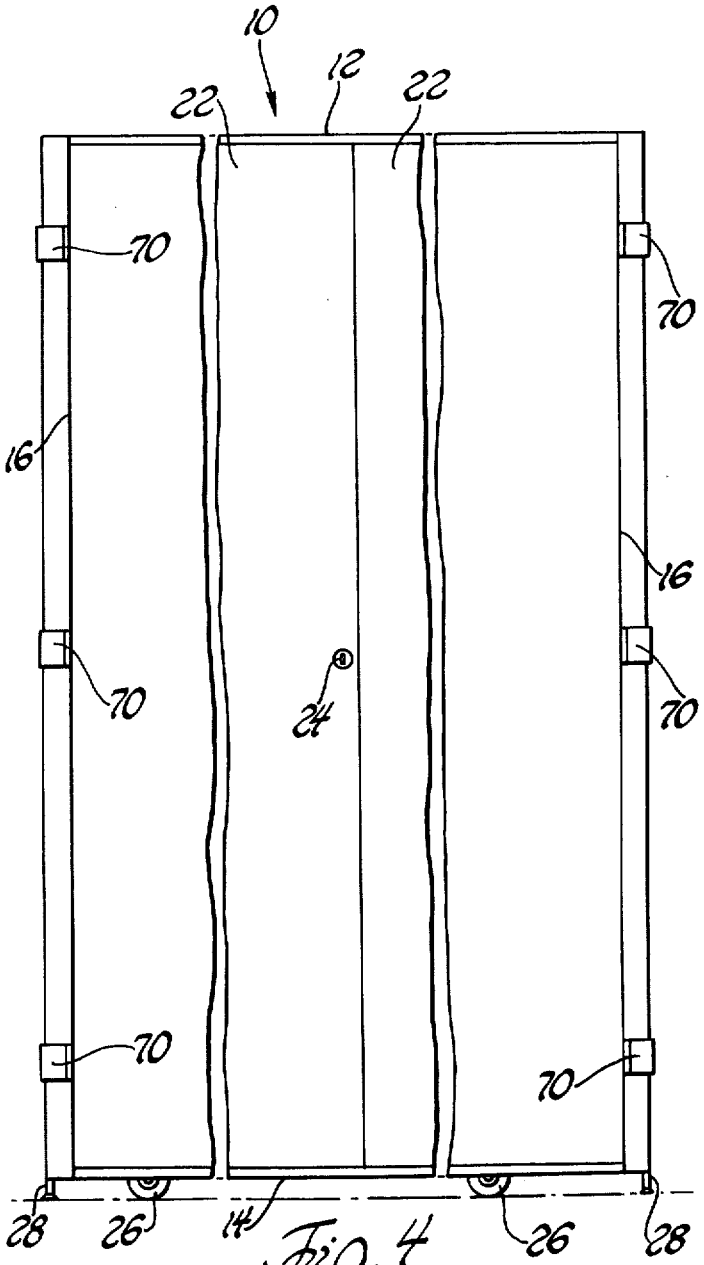
FIG. 4 is a rear-elevational view of the dispensing rack assembly shown in FIG. 1.
Figure 5:
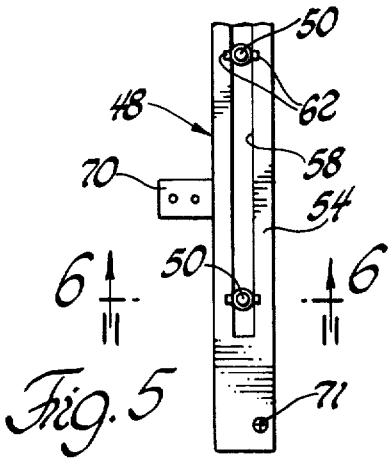
FIG. 5 is a fragmentary view of an anti-theft security device constructed in accordance with the instant invention.

The detection means 48 constitutes an anti-theft security device which preferably includes a pair of elongated support members 54 and 56. The radiant energy emitting means 50 is suppoted by one of the support members 54 and the radiant energy receiving means 52 is supported by the other of the support members 56. Adjustment means is provided for permitting adjustment of the positions of the emitting and receiving means 50 and 52 with respect to the support members 54 and 56. The adjustment means may be of any convenient design. For example, the support members 54 and 56 may be provided with a slot 58 which communicates with the hollow interior 60 of the channel-shaped support member. Both the emitting means 50 and the receiving means 52 may conveniently have a similar external shape, therefore, the adjustment means for both may be of similar design. An example of one possible type of adjustment means is shown in FIG. 6. Referring to FIG. 6, a pair of flanges 62 may be provided which extend laterally from the device and overlap the sides of the support member adjacent to the slot 58. The flanges 62 are held in frictional engagement with the support member by means of a spring 64 and clip 66 arrangement within the support member 54. Specifically, a coil spring 64 surrounds the body of the device 50 and engages an annular flange 68 at the rear of the device. The spring 64 urges the clip 66 into engagement with the inner surface of the walls adjacent to the slot 58. In this manner, the emitting device 50 may be aligned with the receiving device 52 on the other support member 56. Of course, there are numerous other means for adjustably attaching the emitting and receiving devices 50 and 52 to the support members which will become immediately apparent to a mechanic; therefore, it is not intended that the adjustment means be limited to that which is described and shown herein.

As shown in FIG. 1, the radiant energy emitting means 50 and the radiant energy receiving means 52 cooperate in pairs to direct a beam 51 of radiant energy near the access openings 20. In view of the configuration of the dispensing rack 10, the emitting means 50 and receiving means 52 are located laterally from the sides of the access openings 20 in order to direct a beam of radiant energy across the horizontally arranged access openings 20. Additionally, the emitting and receiving means 50 and 52 are located a distance slightly forward of the item nearest the access opening 20 and in the normal path of withdrawal of the item through the access opening such that withdrawal of the item interrupts the beam of radiant energy.

In accordance with one aspect of the invention, the support members 54 and 56 include attachment means for releasably attaching the same to the dispensing rack 10. By way of example, each of the support members 54 and 56 may include a number of Z-shaped brackets 70 which are secured to the support members by means of suitable fasteners 72. Fastener receiving aperatures 74 are also provided for fastening the bracket to the side wall 16 of the dispensing rack 10. Of course, many other means for releasably attaching the support members to the dispensing rack will become immediately apparent to one having ordinary skill in the art, therefore, it is not intended that the attachment means be limited to that which is described and shown herein.

As alluded to above, withdrawal of an item, such as a cigarette carton 36, from within the enclosure interrupts the beam 51 from the emitting means 50. The receiving means 52 senses the interruption in the beam 51 and actuates an alarm or other signal. Many different alarms or signals may be incorporated into the dispensing rack. For example, chimes or other audible alert signals may be triggered which can be heard throughout the store. A light or lights may also be lit. For example, the top section 72 of the dispensing rack 10 may consist of an opaque panel having transparent portions spelling out the words "Cigarettes" and "Thank You". Removal of a carton of cigarettes from one of the compartments causes a light behind the opaque panel to be lit thus lighting up the two signs. In the event that a silent signal is more desirable, a transmitter (not shown) may be provided within the support members 54 and 56 so that upon removal of an item from a compartment, a signal is transmitted to a remote receiver, such as, a small, portable beeper. Alternatively, an alarm buzzer in a manager's office may be energized or a digital counter may be activated. In some cases, a video camera may be mounted in the upper portion 72 of the dispensing rack wherein the lens 74 of the camera is directed toward the front of the dispensing rack. The detection means activates the camera to record the image of the person removing cigarettes from the dispensing rack. In some cases, a video screen 76 may be provided for producing an instantaneous relay from the video camera. For a bona fide customer the display of his image on the screen 76 would be an entertaining novelty, however, to the shoplifter it is an explicit indication that he is being observed.

In order to provide electrical power to the support members 54 and 56, both include electrical outlets 71 for connecting a power cable thereto. The entire wiring arrangement within the support members 54 and 56 is not shown since various arrangements are capable of use once the purpose and function of the invention is understood by reference to the disclosure herein.

Figure 8:
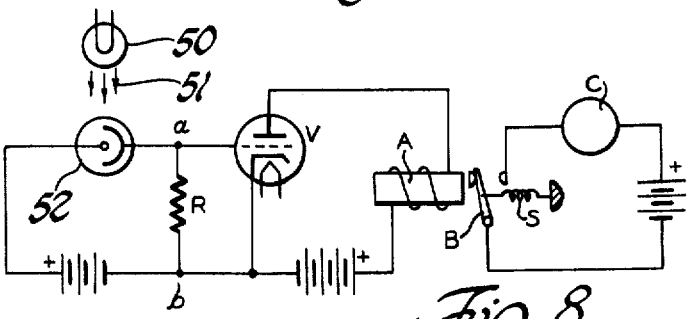
FIG. 8 is a typical circuit employing radiant energy emitting and receiving means for controlling an alarm or signal circuit.

The radiant energy emitting and receiving means 50 and 52 may be of any well-known type. For example, in the preferred embodiment of the invention, the radiant energy emitting means 50 is an incandescent light while the radiant energy receiving means 52 is a photoelectric cell. The use of photoelectric cells for operating a relay which opens or closes a local circuit is well-known. A typical circuit arrangement for accomplishing this function is shown in FIG. 8. While the beam 51 of radiant energy, in this case a beam of light from the incandescent bulb 50, is incident upon the photoelectric cell 52 there is a photoelectric current in the resistor R and the potential of point a is the potential of point b plus the iR drop in the resistor R. The grid of vacuum tube V, which is connected to point a, is therefore only slightly negative, and the plate current is sufficient to actuate the electromagnet A. The electromagnet A attracts the contact arm B thus keeping the local circuit C open. When the light beam 51 is cut off, the point a and, therefore, the grid of the vacuum tube V becomes more negative in the absence of an iR drop in the resistor and the plate current is reduced. The armature B then swings back under the influence of the spring S and closes the local circuit C. The local circuit C may be employed to power any one or more of the alarm signals described above. It should be recognized, however, that a variety of other radiant energy emitting and receiving devices could be employed, as well as variations in the specific circuit described, and thus it is not intended that the instant invention be limited to those elements shown and described herein.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that the invention may be practiced otherwise than as specifically described yet remain within the scope of the appended claims.

I claim:

1. A dispensing rack assembly comprising: enclosure means defining a plurality of side by side compartments for storing items to be dispensed, an access opening extending across and communicating with the interior of said compartments through which items may be withdrawn, means associated with said access opening for allowing only one-at-a-time manual removal of items from each compartment through said access oening and detection means associated with said access opening for detecting the withdrawal of items from said compartments; said detection means including radiant energy emitting means for directing a beam of radiant energy across said access opening and forward of said compartments, receiving means associated with said emitting means for receiving said beam of radiant energy, and circuit means associated with said receiving means including control means responsive to a change in the beam received by said receiving means and signal means actuatable by said control means whereby withdrawal of an item from any one of said compartments changes said beam and actuates said signal means.

2. An assembly as set forth in claim 1 wherein said enclosure means includes a recess adjacent the lower edge of said access opening for exposing a portion of the item nearest said access opening.

3. An assembly as set forth in claim 1 wherein said enclosure means includes an inclined, generally horizontal support surface sloping downwardly toward said access opening and adapted to support vertical stacks of items in askew relationship whereby an item in each stack is positioned near said access opening.

4. An assembly as set forth in claim 3 wherein said enclosure means includes a recess below said support surface defining the lower edge of said access opening for exposing a portion of the underside of each item nearest said access opening.

5. An assembly as set forth in claim 4 wherein said enclosure means includes a panel member having a lower edge defining the upper edge of said access opening, said panel member terminating above said support surface a distance greater than the vertical height of one item and less than twice the vertical height of an item.

6. An assembly as set forth in claim 5 wherein said emitting means and receiving means are located a distance slightly forward of the items nearest the access opening and in the normal path of withdrawal of an item through said access opening such that withdrawal of an item interrupts said beam of radiant energy.

7. An assembly as set forth in claim 6 wherein said emitting means is located laterally from one side of said access opening an said receiving means is located laterally from the opposite side of said access opening to direct a beam of radiant energy across said access opening.

8. An assembly as set forth in claim 7 wherein said enclosure means includes a number of horizontal support surfaces and vertical partitions for dividing said enclosure means into a plurality of levels of compartments having access openings.

9. An assembly as set forth in claim 8 wherein said emitting means and said receiving means are arranged in sets, one being associated with each of said horizontal surfaces to provide a beam of radiant energy across said access openings of the respective horizontal surfaces.

10. An assembly as set forth in claim 9 wherein said emitting means and receiving means are adjustably supported by support members located adjacent the sides of said enclosure means.

11. An assembly as set forth in claim 10 wherein said support members include attachment means for releasably attaching said support members to said enclosure means.

12. An assembly as set forth in claim 1 including support members for supporting said emitting means and said receiving means, said support member including attachment means for releasably attaching said support members to said enclosure means.

13. An assembly as set forth in claim 12 including adjustment means for permitting adjustment of the positions of said emitting and receiving means with respect to said support members.

* * * * *